United States Patent [19]

Heitzman

[11] 4,398,378

[45] Aug. 16, 1983

[54] BUILDING CONSTRUCTION SYSTEM COMPONENT PARTS AND METHOD FOR ASSEMBLING SAME

[75] Inventor: Charles J. Heitzman, Honolulu, Hi.

[73] Assignee: Auto-Cast International, Ltd., Honolulu, Hi.

[21] Appl. No.: 190,381

[22] Filed: Sep. 24, 1980

[51] Int. Cl.[3] ..... E04B 1/00

[52] U.S. Cl. ..... 52/251; 52/259; 52/438; 52/605; 52/606; 52/741

[58] Field of Search ..... 52/259, 250, 251, 605, 52/606, 437, 438, 432, 741

[56] References Cited

U.S. PATENT DOCUMENTS

| | | | |
|---|---|---|---|
| 1,543,509 | 6/1925 | Nelson | 52/438 |
| 3,286,418 | 11/1966 | Radford | 52/606 X |
| 3,491,499 | 1/1970 | Dyer | 52/438 X |
| 3,596,423 | 8/1971 | Jacobus | 52/432 |
| 3,645,056 | 2/1972 | Gerola | 52/259 |
| 3,818,660 | 6/1974 | Dillon | 52/259 X |
| 3,832,817 | 9/1974 | Martens | 52/259 X |
| 3,855,752 | 12/1974 | Aylon | 52/606 X |
| 4,010,581 | 3/1977 | Keturi et al. | 52/259 X |
| 4,147,009 | 4/1979 | Watry | 52/259 X |
| 4,285,179 | 8/1981 | Goidinger | 52/437 X |
| 4,295,313 | 10/1981 | Rassias | 52/438 |

*Primary Examiner*—Carl D. Friedman

[57] ABSTRACT

A system is described for erecting an apartment house or dwelling house from prefabricated components of concrete or other self-hardening materials, the components comprising wall panels, floor panels and reinforcing rods which are grouted together with the reinforcing rods to form joints which result in a finished building structure. The components used in the system and a method for erection of the structure are also described.

4 Claims, 20 Drawing Figures

BUILDING CONSTRUCTION SYSTEM COMPONENT PARTS AND METHOD FOR ASSEMBLING SAME

BACKGROUND OF THE INVENTION

The production of prefabricated molded articles of concrete or other self-hardening moldable material is well-known in the art and a method and apparatus for producing the same is exemplified by U.S. Pat. No. 4,068,996.

There have been problems, however, in the production of prefabricated articles for building construction purposes. In particular, the installation cost of the plants involved in prefabrication techniques and further, the costs of shipping such products has had the result that these products have not been as widely used in the construction industry as they might otherwise be used, even though the on site construction costs of erecting a building from such materials may be substantially reduced from those of conventional construction technology.

The applicant in this invention has developed new techniques for constructing plants for the production of prefabricated concrete products which due to their mobility, may be erected on or close to the site to reduce the cost of production and shipping to an extent which has not heretofore been possible.

In conjunction with this development, Applicant has further developed new techniques in the manufacture of prefabricated modules for the construction of buildings, including novel structural units, namely wall and floor panels, and a method for erecting the same which are unique and not suggested by the prior art.

The features and advantages of the invention will be more apparent from the following detailed description, the accompanying drawings, and the appended claims.

DESCRIPTION OF THE PREFERRED EMBODIMENT

Figure 4:
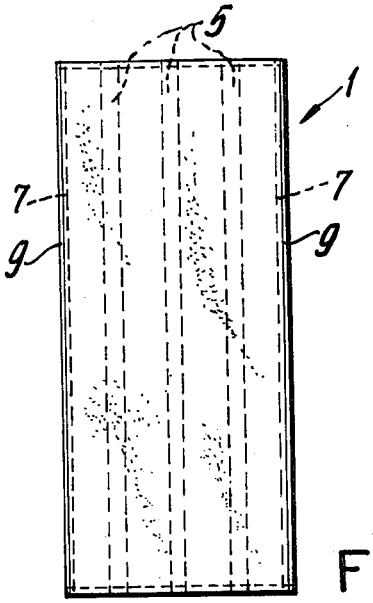
FIG. 4 is a front elevational view of a precast wall panel according to the present invention.
Figure 6:
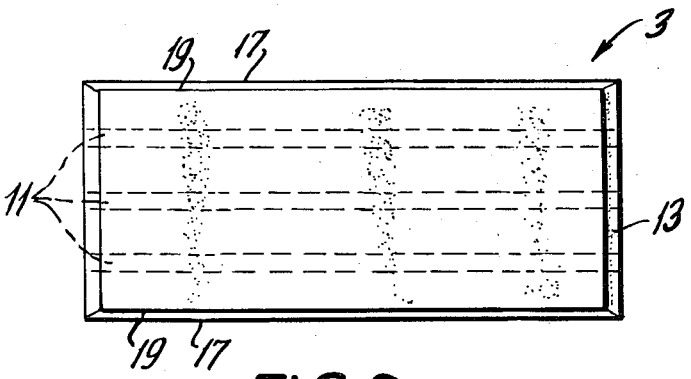
FIG. 6 is a top plan view of a precast floor panel according to this invention.

The system disclosed in the present invention is comprised essentially of two main components, namely, a precast wall panel 1, and a precast floor panel 3, as illustrated in FIGS. 4 and 6, respectively.

Figure 1:
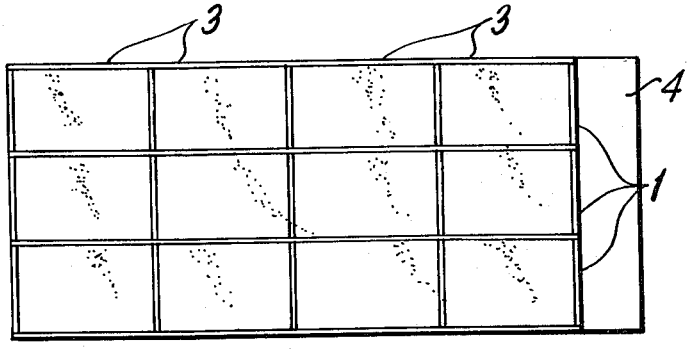
FIG. 1 is a front elevational view of an apartment house or multi-dwelling building constructed according to the system of this invention.
Figure 3A:
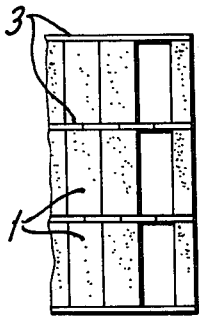
FIG. 3*a* is a sectional view along line 3*a*—3*a* of FIG. 3,showing a corridor communicating with an apartment.
Figure 2:
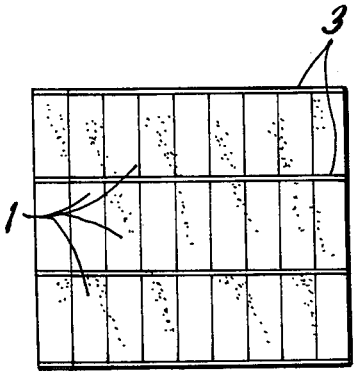
FIG. 2 is a left end elevational view thereof.
Figure 3:
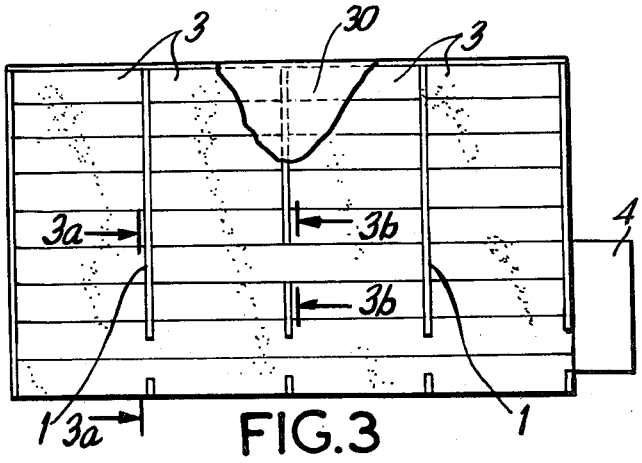
FIG. 3 is a top plan view of the floor and/or roof of FIG. 1, with part of the roofing material broken away.

These basic structural units may be utilized for rapid construction of buildings, particularly apartment houses or similar multi-dwelling units, and such construction is illustrated in FIGS. 1, 2 and 3, as indicated above. The front elevation of FIG. 1 illustrates the skeleton of an apartment house constructed from the wall and floor panels of FIGS. 4 and 6, FIG. 2 being a left end elevational view of such a structure. The top plan view of FIG. 3 illustrates the layout of the floor panels not only for each floor but also for the roof, since the same structural units are employed for the roof as well as the floors, the top of the roof slab being covered by a suitable roofing material 30.

Figure 5:
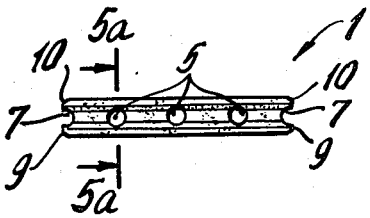
FIG. 5 is a top plan view of FIG. 4.
Figure 5A:
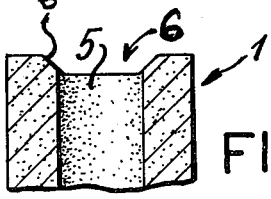
FIG. 5*a* is a partial sectional view thereof along line 5*a*—5*a* of FIG. 5.

The wall panel which forms one of the basic structural units and serves as a column for supporting the floors and roof, is shown in detail in FIGS. 4, 5 and 5*a*. As illustrated in FIG. 4, it comprises a precast rectangular concrete slab 1 provided with a plurality of cylindrical holes or cells 5 for the purpose of inserting reinforcing rods which are later grouted to the floor panels and/or foundation to form rigid joints.

FIG. 5 shows a top plan view of the panel of FIG. 4, which illustrates the relative positions of the cells 5 and the sides of the structure forming wall panels 1. The wall panels may be reinforced with a wire mesh on both sides of the cores to give added structural strength to the panel for handling and construction purposes.

As shown in FIG. 5, the outside longitudinal sides of each wall panel are provided with substantially half-round channels 7 for the purpose of receiving grout after assembly of the panels in abutting relationship to form a complete cell as in cells 5 to secure each panel to the other. At least one outer longitudinal edge of each wall panel 1 is chamfered at 9 but may also be chamfered at the outer edge 10 for aesthetic purposes, but may also be grouted, if desired. One of the outer longitudinal sides may also be provided with a continuous flat surface with chamfered edges where, for example, the wall panel is designed to be used as an exterior corner or a pass-through opening of a building.

The top and bottom of each wall panel is further provided with a longitudinal recess 6 formed by bevels 8 and connecting with cells 5 to form a pocket at top and bottom of the panel, and thereby provide a water stop by means of grout introduced to cells 5 and communicating with such pocket.

The precast floor panels 3, as shown in FIG. 6, also are provided with a plurality of cylindrical holes or cells 11, particularly for the purpose of receiving longitudinal reinforcing rods, but may also be used for housing electrical, plumbing or other connections, depending upon the dimensions of the cells 11 and construction requirements.

Each of the precast slabs 1 and 3 may be cast with blockouts which connect respectively, to the cells 5 and 11 for the purpose of connecting electrical conduits or other fixtures.

Figure 10:
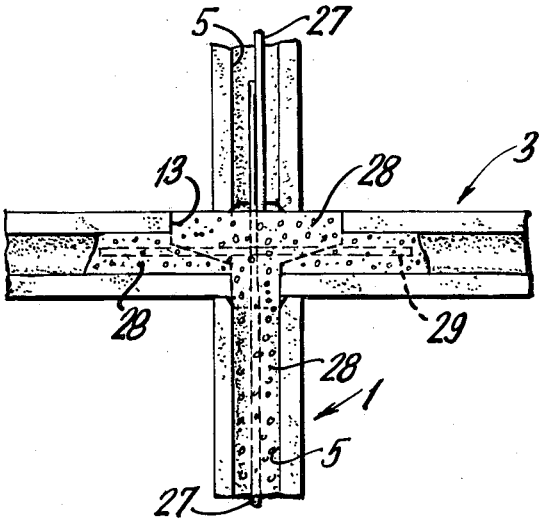
FIG. 10 is an elevational view showing a preferred joint between the wall and floor panels in the interior of a building.

It is to be noted that each end of floor panels 3 is notched at 13 to facilitate the formation of a grouted joint shown, for example, in FIG. 10 wherein the floor panel 3 is supported by the wall panel 1.

Figure 11:
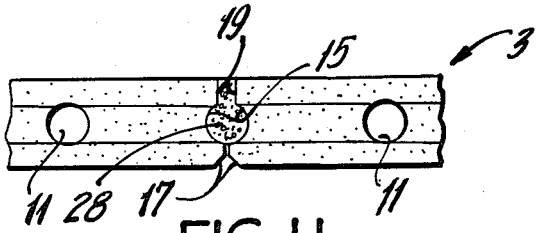
FIG. 11 is a fragmented end elevational view of two precast floor panels showing the manner in which they are assembled and grouted.

The outer sides of each floor panel 3 are provided with substantially half-round channels 15 extending longitudinally along panels 3 on each side for receiving grout after assembling of the floor panels. The lower longitudinal edges of panels 3 are preferably further provided with a chamfer 17, similar to those provided in the wall panels 1 and therein illustrated by reference numbers 9 and 10 of FIG. 5. However, the upper sides of floor panels 3 opposed to the chamfered portions 17 are stepped back at 19 to define a greater space between adjacent abutting floor panels so that upon assembly, as illustrated in FIG. 11, grout 28 may readily be introduced into the joint formed by lower abutting longitudinal surfaces of the floor panels, namely into the substantially cylindrical cells formed by channels 15 of the adjacent floor panels, and therein retained.

Figure 7:
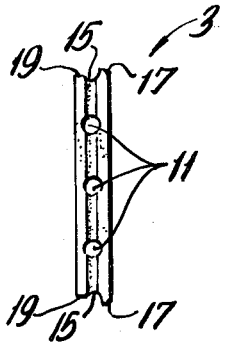
FIG. 7 is a left end view thereof.
Figure 8:
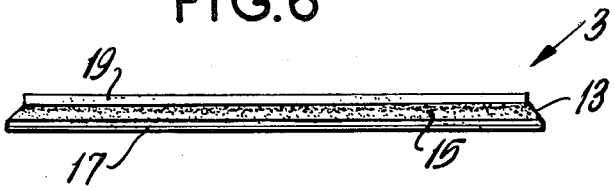
FIG. 8 is a side elevational view thereof.

As in the case of the wall panels, one face of the outer longitudinal sides of the floor panels may be continuous with square edges, where, for example the panels are to be exposed to the outside face of a building; or both sides may be provided with half-round channels when they are to be joined together in a continuous floor construction. Thus, for example, if one longitudinal edge of the floor panel 3 is to be used on the exterior of the building, the construction shown in FIG. 7 would not necessarily be utilized, and it would be preferable to cast one side of that slab with a continuous longitudinal surface and square edges in order to avoid unnecessary grouting.

A method of constructing a building in accordance with the present invention and utilizing the precast wall and floor panels of the present invention is now described.

Figure 9:
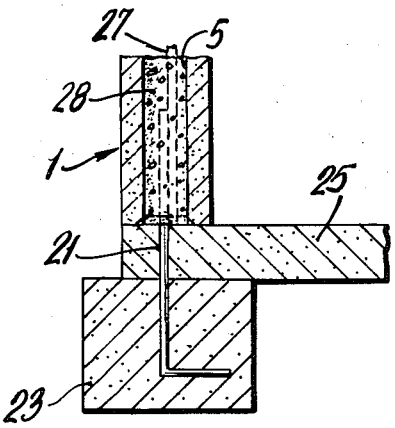
FIG. 9 is a constructional detail showing a section through the footings and slab of a building to be erected according to this invention and a fragmented section of a wall panel supported thereon, after introduction of grout to the wall panel.

First, a footing 23 is poured which includes reinforcing rods or dowels 21 as shown in FIG. 9, embedded in the footing. The footing 23 is topped with a slab 25 in the conventional manner. Thereafter, the wall panels 1 are assembled on the slab 25 with the cells 5 thereof aligned with rods 21 and then vertical reinforcing rods 27 are introduced to cells 5 to form steel splices with rods 21, each of rods 27 being adapted to be received by a corresponding cell 5 of vertical wall panel 1. The reinforcing rods 21 are sufficiently long so as to extend, say about 20 inches, above slab 25 and well within the cells 5 of wall panel 1; and rods 27 are also of sufficient length to extend, say about 20 inches above the assembled wall panels.

Upon positioning wall panels 1 over the slab 25 and reinforcing rods 21 and upright rods 27 around the perimeter of the building and its interior, and after bracing the wall panels in a suitable manner, the floor panels 3 are then erected and supported by the wall panels, as shown in FIGS. 10, 11, 12 and 13.

Figure 12:
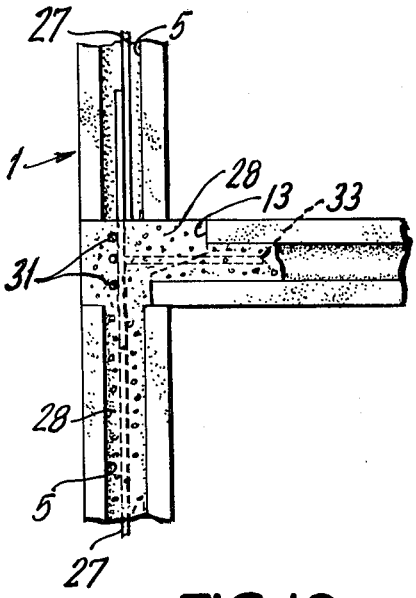
FIG. 12 is an elevational view showing the manner in which the wall and floor panels are joined at the outside of the building; looking at a side of a floor panel.
Figure 13:
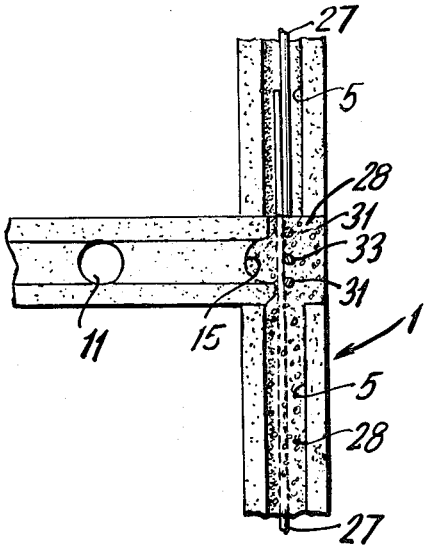
FIG. 13 is an elevational view similar to FIG. 12, looking at an end of a floor panel.

The floor panels are supported in the exterior of the building in a manner shown in FIG. 10; and at the exterior of the building, in a manner shown in FIGS. 12 and 13.

Upon completing this operation, the joints and cells 5 are pump grouted such as at 28 with a suitable concrete or other mixture after introducing thereabove further vertical reinforcing rods 27, and horizontal tie rods 29 and 31 for the joints situated at the interior of the building. A horizontal tie rod 33 hooks around vertical reenforcing rods 27 for the joints situated at the exterior of the building to provide additional strength.

Upon completion of the introduction of the grout to the respective joints as shown, and also between adjacent panels of the wall panels 1 and of the floor panels 3 where they longitudinally abut, the grout is leveled by trowling, permitted to set, and the structure is ready for erection of the next story of the building.

Figure 15:
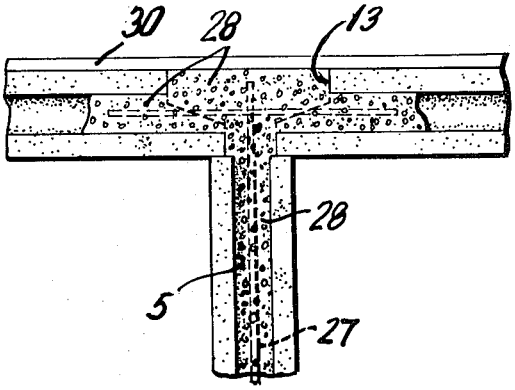
FIG. 15, is an elevational view showing a joint between a wall panel and two roof panels formed by adjacent floor panels in the interior of the building.
Figure 16:
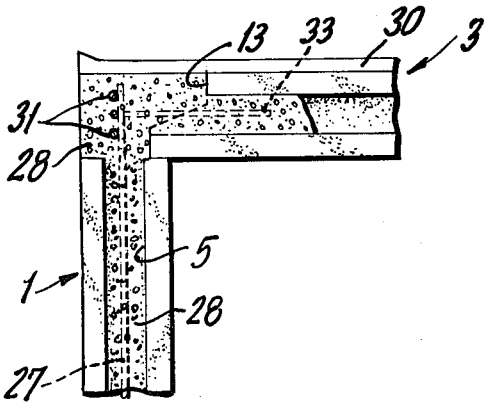
FIG. 16, is an elevational view showing a joint between a wall panel and roof panel at the corner of the building looking at the sides of adjacent wall and roof panels.
Figure 17:
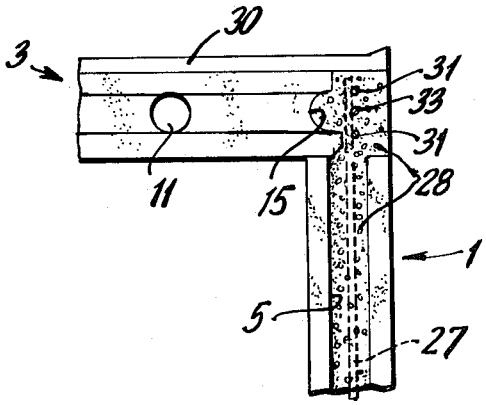
FIG. 17 is an elevational view showing a joint between a wall panel and roof panel over a stairwell 4 shown in FIG. 2; looking at the end of a roof panel and side of a wall panel.

The next story may be erected in the same manner as previously described and until the desired number of stories of the building are constructed, wherein the joints at the roof level are then made as shown in FIGS. 15, 16 and 17. The joint of FIG. 15 is very similar to that made in FIG. 10 which is in the interior of the building. However, in FIGS. 16 and 17, it will be seen that the joint on the outside of the building is constructed in a manner similar to that of FIGS. 12 and 13, which provides an additional tie-rod 33 hooked about reinforcing rod 27 to provide additional structural strength after grouting the joint. The joint of FIG. 17 is especially designed to join a roofed area over a stairwell as shown at 4 in FIGS. 1 and 3.

A suitable roofing material 30 is provided on the top of the structure shown in FIGS. 15, 16 and 17.

Figure 3B:
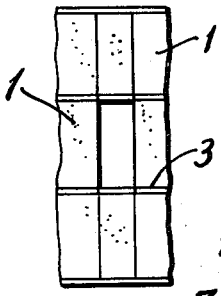
FIG. 3*b* is a view along lines 3*b*—*3b* of FIG. 3 showing a door opening between separating apartment walls.
Figure 14:
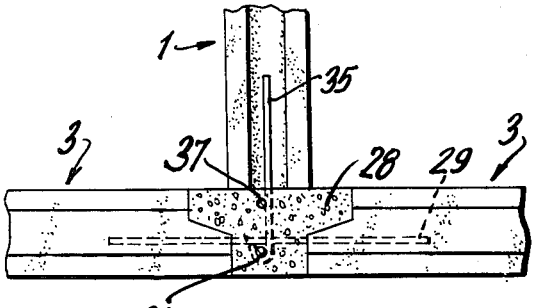
FIG. 14 is an elevational view showing the construction of the adjacent floor panels in relation to the next succeeding upper wall panel when a lower wall panel is omitted to provide an opening.

As indicated above, the aforesaid structure is particularly designed for the construction of apartment houses or multiple dwellings. Thus, it is necessary to provide openings between the various walls of the structure, and these openings are readily provided by leaving out wall panels for doorways and the like, as illustrated in FIG. 3*b*. In such event, the structure must be strengthened in the area over the doorway or opening and accordingly, a special joint is provided by this invention for doing so. This is illustrated particularly in FIG. 14. As will be seen from this figure, the two floor panels 3 are joined in the usual manner but an extra vertical reinforcing rod 35 is provided, and which is hooked around horizontal reinforcing rod 31. Moreover, a further re-enforcing rod 37 is provided to render additional strength to the joint. Furthermore, reinforcing rod 29 is extended to a sufficient extent to bridge the opening provided for the doorway or other opening. The joint provided with these additional reinforcing means is then grouted sufficiently to render the necessary structural strength to support the opening.

It is to be noted that there are distinct advantages in the structural design of the system of this invention and it's speed of erection as well as in its simplicity of design. An apartment building, for example, constructed from the aforesaid precast panels can be erected at the rate of at least one story per day. A slab on grade is usually poured in place in the conventional manner. Steel re-enforcing bars are set in the footings which match up with the spacing of the wall cells as illustrated in FIG. 9.

After the floor slab has been properly cured, the wall panels are erected and braced at the rate of one every three minutes. After all the wall panels have been erected, the floor panels are then set in place at the rate of one every two minutes. After the wall and floor panels have been erected, the necessary re-enforcing steel is placed between the floor joints and in the vertical wall cells and down the wall floor joints as required by the design in the building; and, after the steel has been secured in place, the joints are grouted by using a grout pump or bucketing the concrete. The construction sequence has thus been completed for this story. As indicated above, this sequence is continued until the desired number of floors have been erected and grouted together.

Having described the foregoing invention, it should be clear to those skilled in the art that resort may be had to such modifications and equivalents as may fall within the spirit of the invention and the scope of the appended claims.

I claim:

1. A building construction system comprising:

(a) a plurality of prefabricated wall panels each constructed of self-hardening material and comprising a substantially flat, elongated, rectangular slab provided therein with a plurality of open, longitudinal cylindrical interior cells for receiving reinforcing rods and grout, at least one longitudinal side of each panel being provided with a substantially half-round channel extending thereacross centrally in the longitudinal direction of the panel to form a cell and permit the introduction of grout when two or more panels are erected and abutting one another; and (b) a plurality of pre-fabricated floor panels, supported by the aforesaid wall panels and constructed of self-hardening material and comprising a substantially flat, elongated, rectangular slab provided with a plurality of open longitudinal, cylindrical interior cells for receiving reinforcing rods, electrical conduit, and the like, at least one longitudinal side of each floor panel being provided with a substantially half round channel extending thereacross centrally in the longitudinal direction of the floor panel to form a cell when two or more floor panels are erected and longitudinally abutt one another, the corresponding upper longitudinal edges thereof being spaced inwardly from the abutting lower longitudinal edges of adjacent panels to facilitate the introduction and retention of grout into substantially cylindrical cells formed by said abutting panels when the grout is introduced from the top of two adjacent floor panels, the transverse ends of each floor panel being notched from the top surface thereof to facilitate the introduction of grout when the ends thereof are supported by and secured to corresponding wall panels by grout and horizontal and vertical tie rods; and (c) horizontal and vertical reinforcing rods respectively disposed within cells of said floor panels and wall panels and connected to one another and rigidly secured therebetween and to said panels by means of grout introduced to the cells and to the junctions between said walls and floor panels.

2. A method of constructing a building from prefabricated wall and floor panels said wall panels being constructed of a self-hardening material and comprising a substantially flat, elongated, rectangular slab provided therein with a plurality of open longitudinal cylindrical interior cells for receiving reinforcing rods and grout, at least one longitudinal side of each panel being provided with a substantially half-round channel extending thereacross centrally in the longitudinal direction of the panel to form a cell and permit the introduction of grout when two adjacent panels are erected and abutting one another, at least one end of said panel being provided with a transverse recess communicating with said cells to provide a water stop upon introduction of grout to said cells, and said floor panels being constructed of a self-hardening material, and comprising a substantially flat elongated rectangular slab provided with a plurality of open longitudinal cylindrical interior cells for receiving reinforcing rods, electrical conduit, and the like, at least one longitudinal side of each panel being provided with a substantially half-round channel extending thereacross centrally in the longitudinal direction of the panel to form a cell when two or more panels are erected and longitudinally abutt one another, the corresponding upper longitudinal edges thereof being spaced inwardly from the lower edges of adjacent panels to be abutted to facilitate the introduction and retention of grout into substantially round channels formed by said abutting panels when the grout is introduced from the top of two adjacent floor panels, the transverse ends of said floor panel being notched from the top surface thereof to facilitate the introduction of grout when the ends thereof are supported by and secured to corresponding wall panels by grout and reinforcing rods, said method comprising:

(a) pouring a foundation to support said wall panels and upright reinforcing rods adapted to be received by the open cells of said wall panels;

(b) tying further upright reinforcing rods to the aforesaid upright reinforcing rods;

(c) erecting said wall panels over said reinforcing rods and bracing the same;

(d) erecting said floor panels and supporting the same on said wall panels to form a first story;

(e) introducing horizontal reinforcing rods between the open cells of opposed floor panels, extending horizontal reinforcing rods across the transverse ends of opposed floor panels and across the transverse ends of said lower wall panels and tying further upright re-enforcing rods to said last named upright reinforcing rods;

(f) grouting the joints defined by said wall panels, floor panels and reinforcing rods; and (g) repeating the above procedure until the desired number of stories of the building have been erected.

3. A method according to claim 2, wherein when a wall panel is eliminated to form an opening in the structure, the horizontal reinforcing rod between the cells of adjacent floor panels exceeds the length of the opening and bridges the same and an upright reinforcing rod provided with a hook engages and supports a horizontal reinforcing rod extending transversely across the ends of the wall and floor panels to form a joint therebetween.

4. A method according to claim 2, wherein the joint between the floor and wall panels at the exterior of the building includes horizontal reinforcing rods in the floor panel cells, each with a hooked outer end which engages corresponding upright reinforcing rods in the wall panel cells to form a joint between said wall and floor panels.

* * * * *